United States Patent [19]

Heisey, Jr. et al.

[11] Patent Number: 4,873,808

[45] Date of Patent: Oct. 17, 1989

[54] SPACER BLOCK FOR STANDING SEAM ROOF

[75] Inventors: Raymond K. Heisey, Jr.; W. David Barker, both of Kansas City; Arturo C. Mariano, Independent; Vernon L. Thurnau, Kansas City, all of Mo.

[73] Assignee: Butler Manufacturing Company, Kansas City, Mo.

[21] Appl. No.: 328,717

[22] Filed: Mar. 27, 1989

Related U.S. Application Data

[63] Continuation of Ser. No. 602,488, Apr. 20, 1984, abandoned.

[51] Int. Cl.[4] ..... E04D 1/34; E04B 5/00

[52] U.S. Cl. ..... 52/478; 52/520; 52/544

[58] Field of Search ..... 52/478, 485, 486, 404, 52/608-611, 464, 467, 520, 544; 24/561, 563, 564; 110/339

[56] References Cited

U.S. PATENT DOCUMENTS

| | | | |
|---|---|---|---|
| 1,236,654 | 8/1917 | Baltzley | 24/564 |
| 1,429,182 | 9/1922 | Ashley | 24/563 |
| 1,805,425 | 5/1931 | Stocks | 24/563 |
| 3,021,581 | 2/1962 | Cook et al. | 24/561 |
| 3,029,561 | 4/1962 | Clay | 52/464 |
| 3,056,362 | 10/1962 | Hosbein et al. | 110/339 |
| 3,135,070 | 6/1964 | Waring et al. | 50/221 |
| 3,376,680 | 4/1968 | Gyekis | 52/467 |
| 3,474,583 | 10/1969 | Manias | 52/302 |
| 3,512,227 | 5/1970 | Krawagna | 248/113 |
| 4,213,282 | 7/1980 | Heckelsberg | 52/404 |
| 4,295,304 | 10/1981 | Kim | 59/90 |
| 4,332,060 | 6/1982 | Sato | 24/67.9 |
| 4,346,543 | 8/1982 | Wilson et al. | 52/404 |
| 4,408,423 | 10/1983 | Lautensleger et al. | 59/90 |
| 4,446,665 | 5/1984 | Berger | 52/404 |

FOREIGN PATENT DOCUMENTS

| | | | |
|---|---|---|---|
| 573405 | 3/1924 | France | 24/561 |
| 869779 | 6/1961 | United Kingdom | 52/486 |

*Primary Examiner*—James L. Ridgill, Jr.

*Attorney, Agent, or Firm*—Shoemaker and Mattare, Ltd.

[57] ABSTRACT

Support structure for holding a plurality of roof panels during assembly of a standing seam roof on a prefabricated building including a spacer block having an elongated body with predetermined shaped ends thereon. In one embodiment one end is of square configuration and the other end is of compound tapered configuration. In another embodiment the end of square configuration is provided with a projecting tenon thereon for positive engagement with inside flanges of a roof panel yoke fastening/retainer clip. In a modification of this embodiment, pre-formed notches or recesses are provided for ease in installation of this end with the roof panel fastening/retainer clip. The other end of the spacer block having a pointed configuration may be of compound tapered form, conical form, semi-elliptical or oval form, or a combination of these described shapes. Also, the end may be completely rounded or semi-rounded with a blunt tip.

In one embodiment of the invention, the spacer block is of elongated rectangular configuration with its length many times longer than the overall width thereof. In a further modification the spacer block is of oxbow configuration to provide maximum support upon a double flanged supporting roof purlin. Either the rectangular configuration or the oxbow configured spacer block can be provided with any of the previously described ends in any desired combination thereof.

Preferably, each spacer block is made of lightweight, insulating type material. A pattern for cutting same from a large piece of material, and the method of installation of the support structures, are also part of the present invention.

22 Claims, 8 Drawing Sheets

SPACER BLOCK FOR STANDING SEAM ROOF

This is a continuation of co-pending application Ser. No. 06/602,488 filed on Apr. 20, 1984 now abandoned.

BACKGROUND OF THE INVENTION

1. Field of the Invention

This invention relates to roof structure of standing seam type construction and the spacer blocks as used therewith for supporting the roof panels upon the building roof elements.

2. Description of the Prior Art

Known type roof constructions employ spaced spacer blocks under the plurality of adjacent roof panels for supporting same from the building roof elements. While presently known spacer blocks function fairly well, there is still room for improvement thereon. Known prior art patents which may be pertinent to the present invention are as follows:

Lautensleger et al.—U.S. Pat. No. 4,408,423—Oct. 11, 1983

Wilson et al.—U.S. Pat. No. 4,346,543—Aug. 31, 1982

Kim—U.S. Pat. No. 4,295,304—Oct. 20, 1981

Heckelsberg—U.S. Pat. No. 4,213,282—July 22, 1980

Manias—U.S. Pat. No. 3,474,583—Oct. 28, 1969

Waring et al.—U.S. Pat. No. 3,135,070—June 2, 1964

The Waring et al. U.S. Pat. No. 3,135,070 teaches building and roof construction wherein roof panels are interconnected with supporting structure being employed therewith for providing proper backing therefor.

The Manias U.S. Pat. No. 3,474,583 discloses metal wall structure employing insulation as a backing therefor together with spacer strips for supporting the wall panels.

U.S. Pat. No. 4,213,282 to Heckelsberg shows roof construction employing multiple roof panels having a connected standing seam connection together with roof attachment clips therefor. FIGS. 16–19 show spacer blocks 123 for supporting the roof panels upon the roof purlins. The attachment clips 27' are provided with prongs 126 which engage with the ends of the spacer blocks 123 to hold them in position. However, this holding structure is quite different from that of the present invention.

U.S. Pat. Nos. 4,295,304 to Kim, 4,346,543 to Wilson et al., and 4,408,423 to Lautensleger et al. all show roof panel mounting structure for buildings together with the structural components for affixing and supporting same thereon. However, none of them teach the many important features of the present invention.

SUMMARY OF THE INVENTION

An object of the present invention is to provide an improved spacer block for roof panel construction which is provided with aligning and holding structure at each end thereof. This is designed for proper association with yoke type roof panel fastening clips.

A further object of the present invention is to provide roof panel supporting structure employing yoke type roof clips and spacer blocks for mounting therebetween with complementary aligning structures with both the yoke clip and the spacer blocks.

A still further object of the present invention is to provide both rectangular shaped spacer blocks as well as oxbow shaped spacer blocks for supporting roof panels thereupon. The oxbow shape adds additional support when used with certain types of roof framing elements.

Another further object of the present invention is to provide a pattern for use in cutting oxbow shaped spacer blocks from a large original piece of insulation material.

A still further object of the present invention is the method of installing the improved spacer blocks together with aligning and holding roof panel clips of the present invention.

The present invention offers many new and novel features over that of the known prior art. With the new type roof panel attachment and supporting yoke clip as disclosed in some of the assignee's co-pending applications, the current type of spacer block could not properly be used because of the reduced width of the new yoke clip at the base thereof. Quite obviously, it is very desirable to have the spacer blocks as continuous as possible between the roof panels they are supporting and the roof framing elements upon which they rest and/or the insulation therebetween, the purpose being to get maximum thermal performance and insulation between the roof panels which form the outer surface of the building roof and the metal supporting roof joists thereunder.

The present invention really involves four basic embodiments, as shown in the drawings. One embodiment has a tapered end of several different modified constructions and a short tenon projection on the other end thereof. Another embodiment has the same ends, but with the middle portion of the spacer block being shaped like an "oxbow" for the purpose of having the spacer lay over both flanges of certain types of truss purlins. This same embodiment could be used with bar joist or other wider structural roof support members. The oxbow embodiment provides a little better bearing condition than the first rectangular embodiment.

A further basic shape is a square end at one end of the spacer block and a longer, larger tenon projection at the other end. The additional depth of this extended tenon is for the purpose of getting its end as close to the square end of the next abutting spacer block as possible. There also are envisioned some design modifications for this tenon. During installation, basically the tenon is pushed into the bottom of the substantially U-shaped yoke. This yoke, instead of being exactly U-shaped, tapers to a smaller dimension at the base, and when the spacer block is pushed into place, the flanges of the yoke actually cut into the edges of the tenon. Thus, of course, this end of the spacer block is quite securely fastened in place. An alternate modification of this long tenon is to have the tenon edges pre-notched. With the pre-notched edges or recesses, the block can be easily slipped into place together with the yoke flanges without deformation whatsoever of the spacer block end. Of course, this pre-notched recess concept can also be used with the first embodiment described above. A further embodiment has the square end and large projecting tenon with the oxbow design already described.

Buildings have been experimentally constructed and tested using both the tapered end and the butt end designs. At this point the preferred embodiment appears to be the butt end with long projecting tenon.

It should be noted that with the block embodiment having the tapered end, this taper can be compound curved, conical or oval taper, rounded blunted end, or combinations of these ends. The important concept is that the end is reduced at the very tip thereof, as compared to the main body end of the spacer block.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
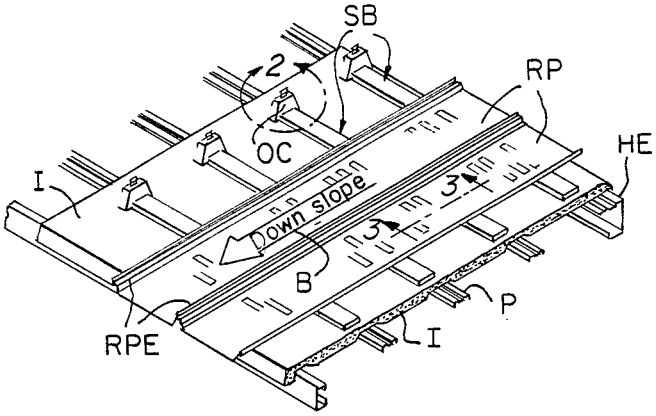
FIG. 1. (PRIOR ART)
FIG. 1 is a perspective view of prior art clip and spacer block roof panel construction.
Figure 2:
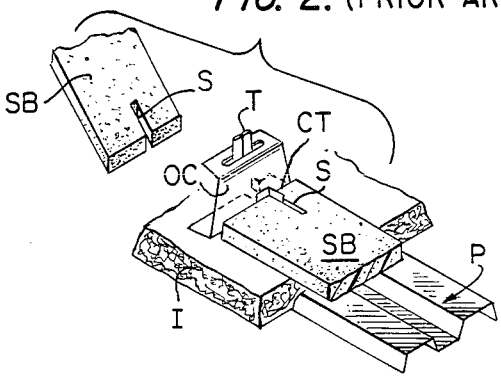
FIG. 2. (PRIOR ART)
FIG. 2 is an enlarged view of the encircled portion 2 of FIG. 1.
Figure 3:
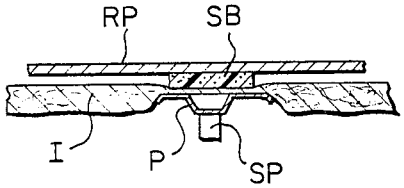
FIG. 3. (PRIOR ART)
FIG. 3 is a fragmentary portion, partly in crosssection, taken along line 3—3 of FIG. 1.

Looking at FIGS. 1–3 of the drawings, a roof panel standing seam construction of known type is depicted. Roof framing and supporting elements are shown for a single span, one-direction sloping roof. A high edge roof ridge element HE is depicted, a plurality of roof purlins P therebetween, and a low edge roof supporting element LE. Preferably, batts of insulation I are laid traversely across these roof supporting elements from the ridge element HE to the lower edge element LE. A line of roof panel attachment clips OC are then appropriately mounted on the roof purlins and attached thereto through the insulation I. FIG. 2 shows this in enlarged detail. Of course, as is well known, the beginning course at the very edge of the roof has a slightly different construction than this; however, for the present invention, the showing of FIGS. 1–3 taken in the mid-portion of the roof is sufficient. After the clips OC have been installed, then a spacer block SB can be positioned and aligned by the use of the slit S therein and the clip tab CT which extends on either side of clip OC. The roof attaching tab T is clearly shown for interengagement with the interengaged roof panel RP edges RPE. These edges RPE are appropriately double seamed as disclosed in the prior art.

Figure 4:
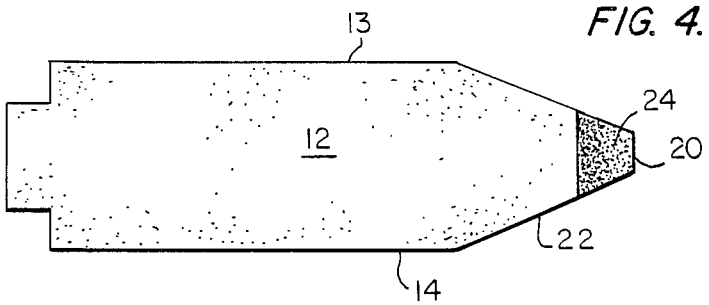
FIG. 4 is a top plan view of the spacer block embodiment having a short tenon at one end and a compound tapered end at the other.
Figure 5:
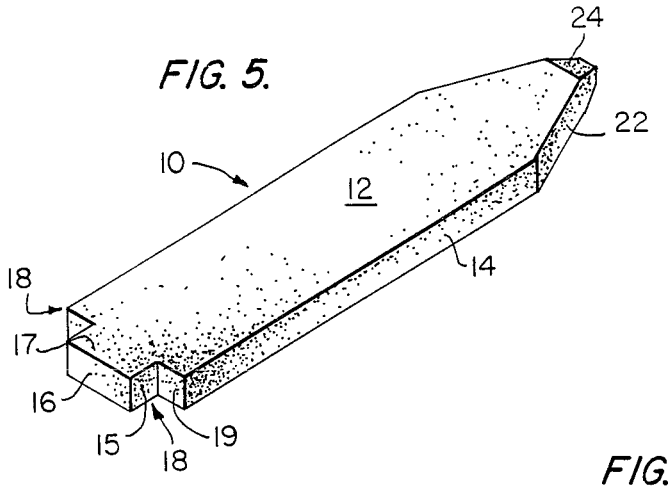
FIG. 5 is a perspective view of the FIG. 4 embodiment.

Looking at FIGS. 4 and 5 of the drawings, one embodiment of the present invention is depicted. Reference numeral 10 indicates in general the spacer block of this invention. An elongated, substantially rectangular block 12 is provided with side edges 13 and 14 and at one end 16 is provided with right angle recesses 18. The recesses 18 leave the short tenon side walls 15 in the sub-end portions 19.

The other end of this embodiment is provided with a compound tapered point divided by the inwardly tapering sides 22 and 23 and the downwardly tapered upper surface 24 ending in a blunt end tip 20.

Figure 6:
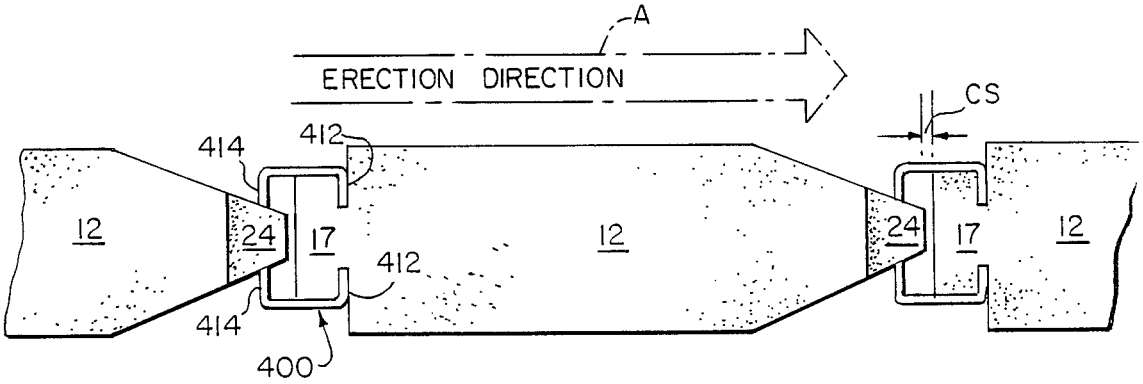
FIG. 6 is a top plan view of the FIG. 4 embodiment in schematic form showing the installation thereof.
Figure 7:
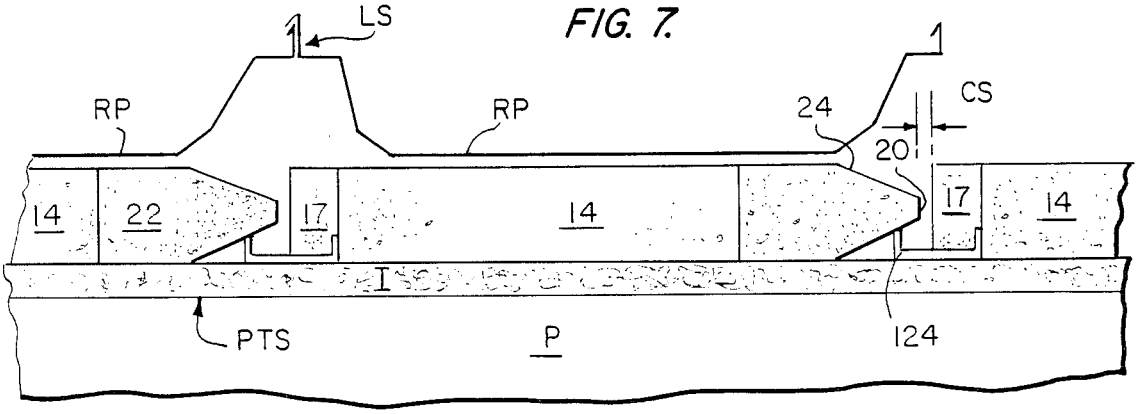
FIG. 7 is a side elevational view of the FIG. 6 installation showing roof panels as supported by the roof clips and spacer blocks of the present invention.

Erection of this embodiment is as depicted in FIGS. 6 and 7 of the drawings. The compound tapered end of the left-most spacer block is shown, and after suitable mounting upon the insulation over a roof purlin, has the yoke 400 moved into position thereagainst. The flanges 414 at one side of the fastening clip yoke 400 will normally abut against a portion of the compound tapered end. Next, the tenon end 17 of another spacer block 12 is placed within the basically U-shaped yoke and pushed into place so that the flanges 412 of the yoke will cut into the soft foam or polystyrene insulating material from which the spacer blocks are preferably made.

As can be seen in both FIGS. 6 and 7, preferably a clearance space CS exists between the tip end 20 of the compound tapered end of a spacer block 12, and the short tenon end 17 of another spacer block. Also as can be seen in FIG. 7, the lower tapered surface 124 of the compound tapered end is shown. FIG. 7 also shows the purlin P, purlin top surface PTS and the insulation I therebetween. The erection direction A is indicated in this particular installation as from left to right.

Figure 8:
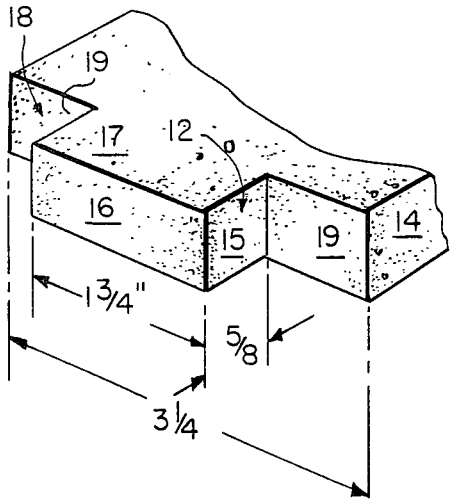
FIG. 8 is an enlarged end portion of the FIG. 4–7 embodiment showing the preferred dimensions of the short tenon end.

FIG. 8 shows the preferred dimensions of the short tenon end of the embodiment of FIGS. 4–7. While other dimensions can be used, these dimensions have been found to be quite effective in actual tests.

Figure 9:
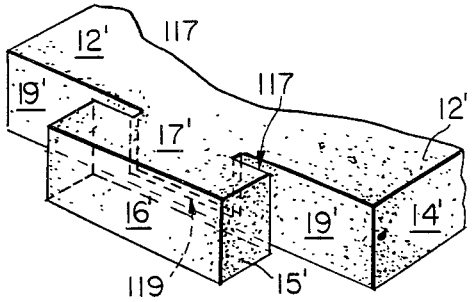
FIG. 9 is a modification of the FIG. 4–8 embodiment wherein the short tenon end is provided with prenotched recesses therearound.

FIG. 9 shows a modification of the embodiment of FIGS. 4–8, wherein pre-notching is provided along three sides of the tenon 17. This tenon 17' has side notches 117 and a notch from below 119. These pre-notched recesses permit the tenon of this modification to be easily engaged with the yoke flange without any deformation of the tenon end of the device.

Figure 10:
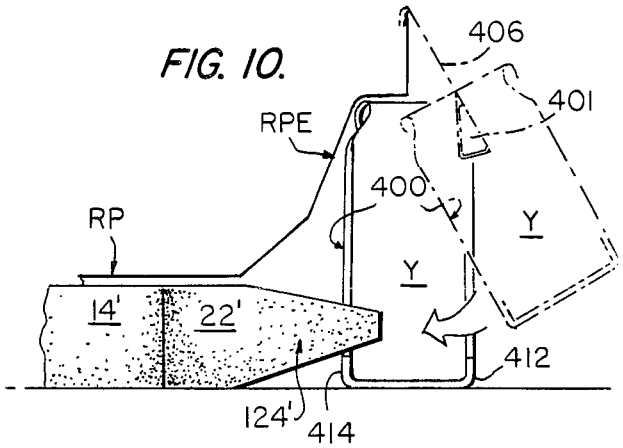
FIG. 10 is a side elevational view of the FIG. 9 embodiment with the compound tapered end and roof clip being installed.

FIG. 10 shows in enlarged detail the compound tapered end of both of the above-described embodiments together with a complete depiction of the roof panel clip Y. This view shows how the tab 406 is interengaged with the top right-most edge of the roof panel edge RPE after the roof panel RP has been placed upon the spacer block 12 already installed.

Figure 11:
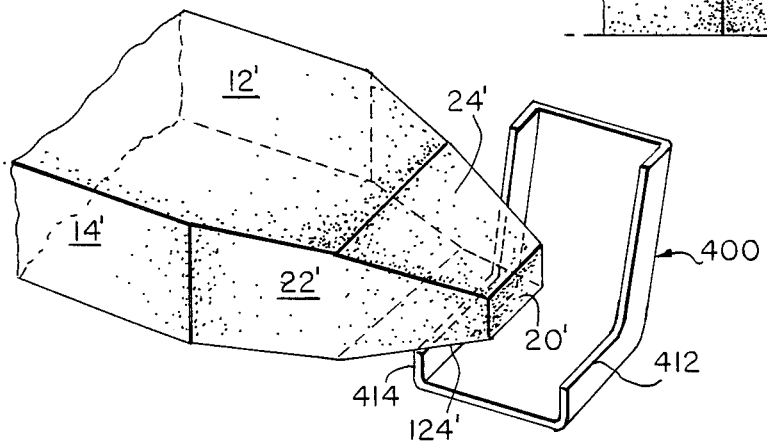
FIG. 11 is a perspective view of the FIG. 10 installation.
Figure 12:
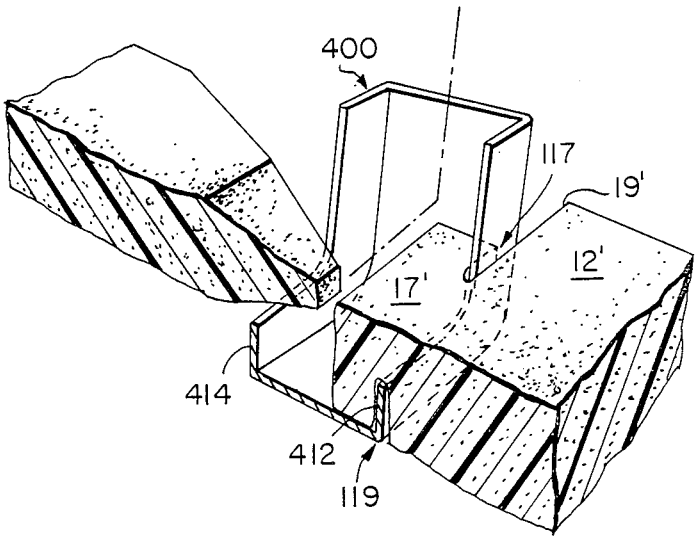
FIG. 12 is a perspective view of the short tenon end installation of a further spacer block after completion of the FIG. 11 portion of the overall installation.
Figure 13:
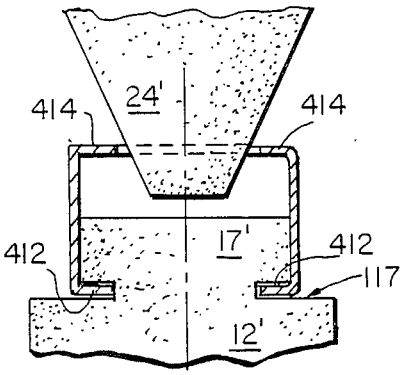
FIG. 13 is a top plan view of the short tenon end of the FIGS. 9–12 embodiment.

FIGS. 12 and 13 show how the short tenon with prenotched areas 117, 119 is installed with the yoke 400 as depicted in FIGS. 10 and 11.

Figure 14:
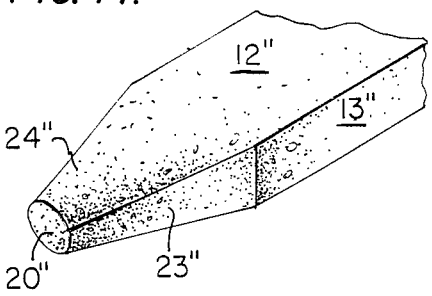
FIG. 14 is a perspective view of the conical/elliptical tapered end modification as distinguished from the compound tapered end previously described and shown.

Looking at FIG. 14, a modification of the compound tapered end of the spacer block is shown. This modification comprises a tapered conical end 24'' having tapered partial sides 23'' and ending in a blunt point of substantially circular configuration 20''. Of course, there are elliptical, oval, semi-conical tapered ends envisioned by the present invention. The important concept is that the blunt end 20, etc. is of substantially smaller size or area than the cross-sectional area of the main body of the spacer block.

Figure 15:
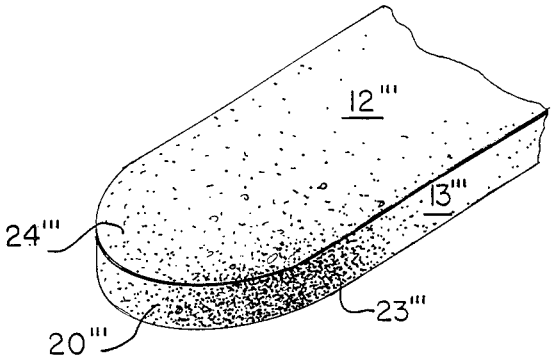
FIG. 15 is a perspective view of a modification involving a rounded/blunted end for the spacer block.

FIG. 15 shows another alternative which may be used. In this embodiment, the spacer block 12''' ends in a rounded end 24''' with a slightly blunted tip end 20''. The sides 23''' are rounded rather than tapered in this embodiment.

Figure 16:
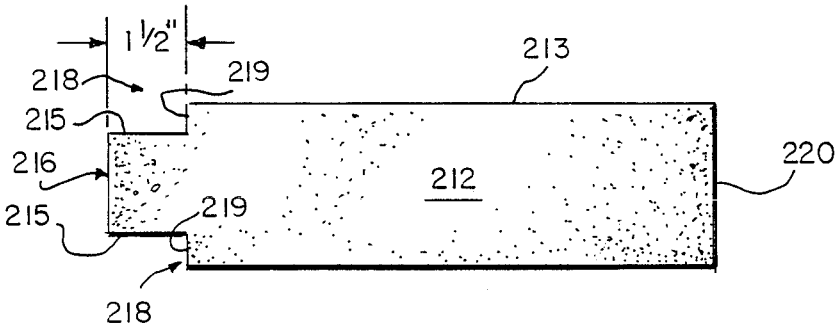
FIG. 16 is another embodiment showing a long tenon end modification together with a square other end.
Figure 17:
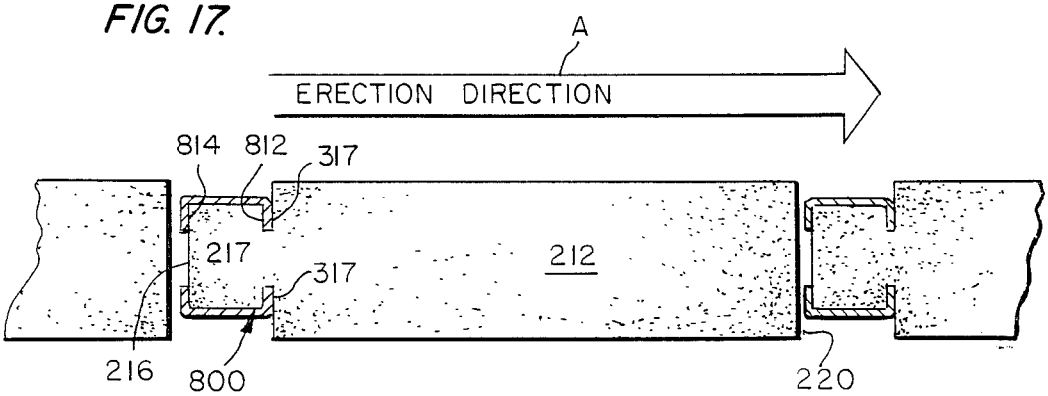
FIG. 17 is a top plan view of an installation of the FIG. 17 embodiment.
Figure 18:
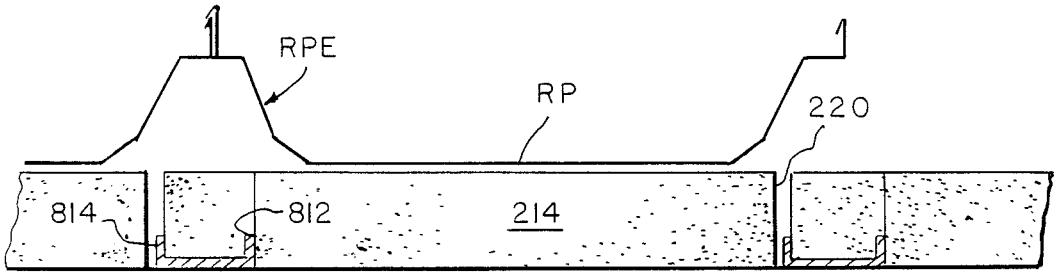
FIG. 18 is a side elevational view of the installation depicted in FIG. 17.
Figure 19:
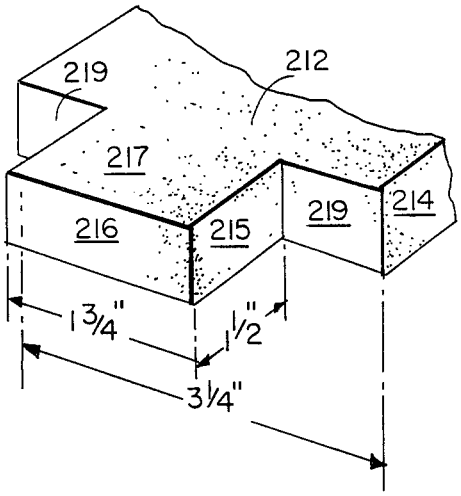
FIG. 19 is a perspective view of the long tenon end embodiment together with appropriate dimensions therefor.

FIG. 16 shows a further embodiment wherein a spacer block 212 with respective elongated sides 213 and 214 has a square end 220 in place of the compound tapered end of the previous embodiments, and the other end 217 has a deep or long tenon configuration. The deep tenon is formed by the recessed areas 218 which are removed from this end of the spacer block, thus forming the end 216 of the tenon with respective sides 215 and end shoulders 219. The desired dimensions for this embodiment are depicted in FIG. 19 of the drawings. FIGS. 17 and 18 show the manner of installation of this embodiment of the present invention. The tenon 217 is placed into position with the yoke 800 of the retainer clip and then pushed downwardly so that the respective flanges 812 on the yoke retainer clip 800 force themselves into the sides and bottom junction of tenon 217 with the main body of the spacer block 212.

Figure 20:
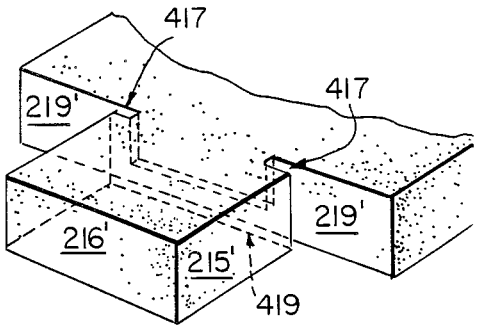
FIG. 20 is a perspective view of a pre-notched modification of the long tenon end embodiment of FIG. 16–19.

In FIG. 20 a modified embodiment of the modification of FIGS. 16–19 is shown. This embodiment is similar to the short tenon modification wherein recesses are provided around at least three sides of the tenon where it adjoins the main body of the spacer block, thus forming recesses 417 and 419 as indicated in this FIG.

FIGS. 21–24 show the manner of installation of the FIG. 20 embodiment of the present invention. The steps of installation are substantially the same as those already set forth, so it will not be again repeated. From the drawings themselves, the method of installation should be readily apparent.

Figure 25:
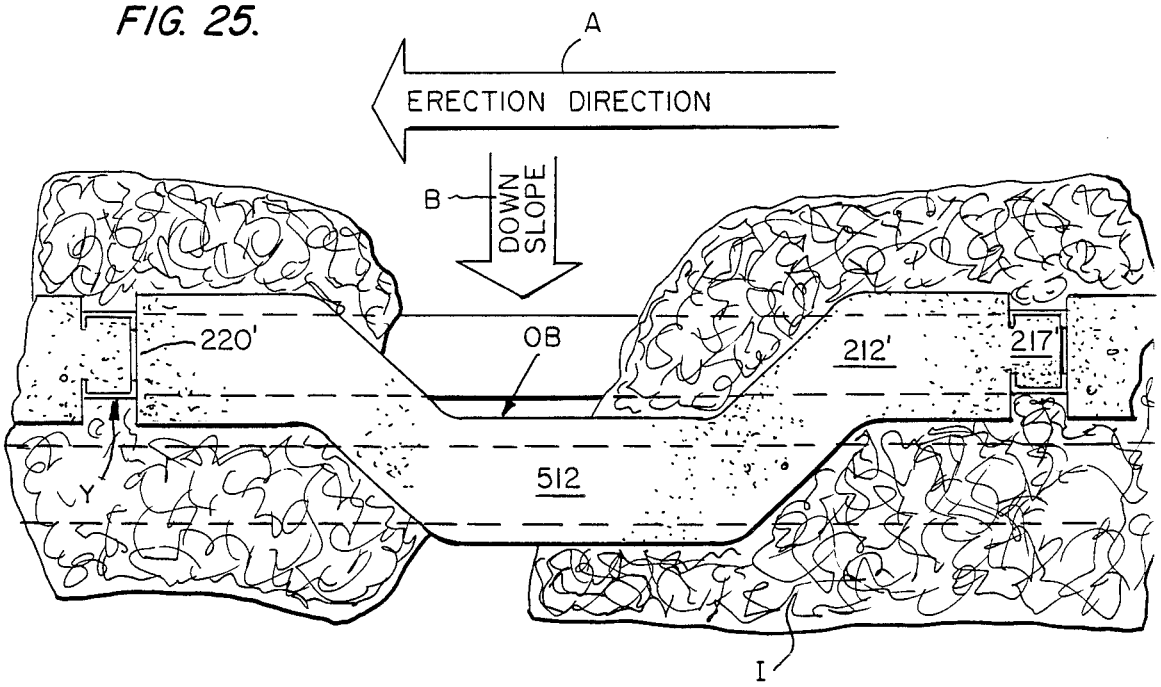
FIG. 25 is a top plan view of an oxbow shaped modification to the long tenon square end embodiment.

FIG. 25 shows a further modification of the spacer block of the present invention wherein the main body 512 of the block is in a shape having an "oxbow" configuration. A long tenon end 217' is provided at the first end and a square shaped blunted end 220' at the other. The method of installation as depicted in FIG. 25 is opposite to those shown and described previously. That is, the direction is from right to left, as indicated by the direction arrow A', rather than in the other direction previously described. The downslope of the roof is indicated again by arrow B.

Figure 26:
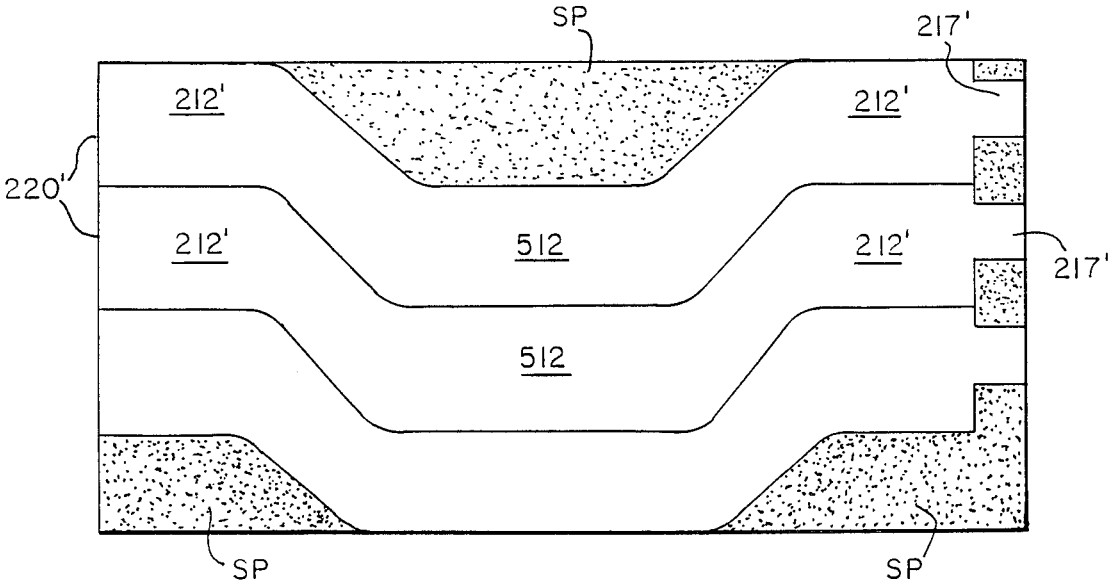
FIG. 26 is a template or pattern for use in making the FIG. 25 oxbow shape embodiment from a large piece of basic material.

FIG. 26 shows a pattern which may be used for forming or cutting out the oxbow embodiment of the present invention. As can be clearly seen, the square ends 220 are provided along the left margin of the pattern, while the long tenon ends 217' are provided along the right margin of the pattern. Appropriate scrap portions SP are indicated by the cross-hatching in this figure. While a small amount of scrap SP will result in this embodiment, nevertheless as much of the available virgin material from which the spacer block is cut will be used as possible. Of course, in the spacer block of the elongated rectangular configuration, substantially all of the virgin material will be used, since only the tenon ends and/or compound tapered ends will produce any scrap from the basic material.

Figure 27:
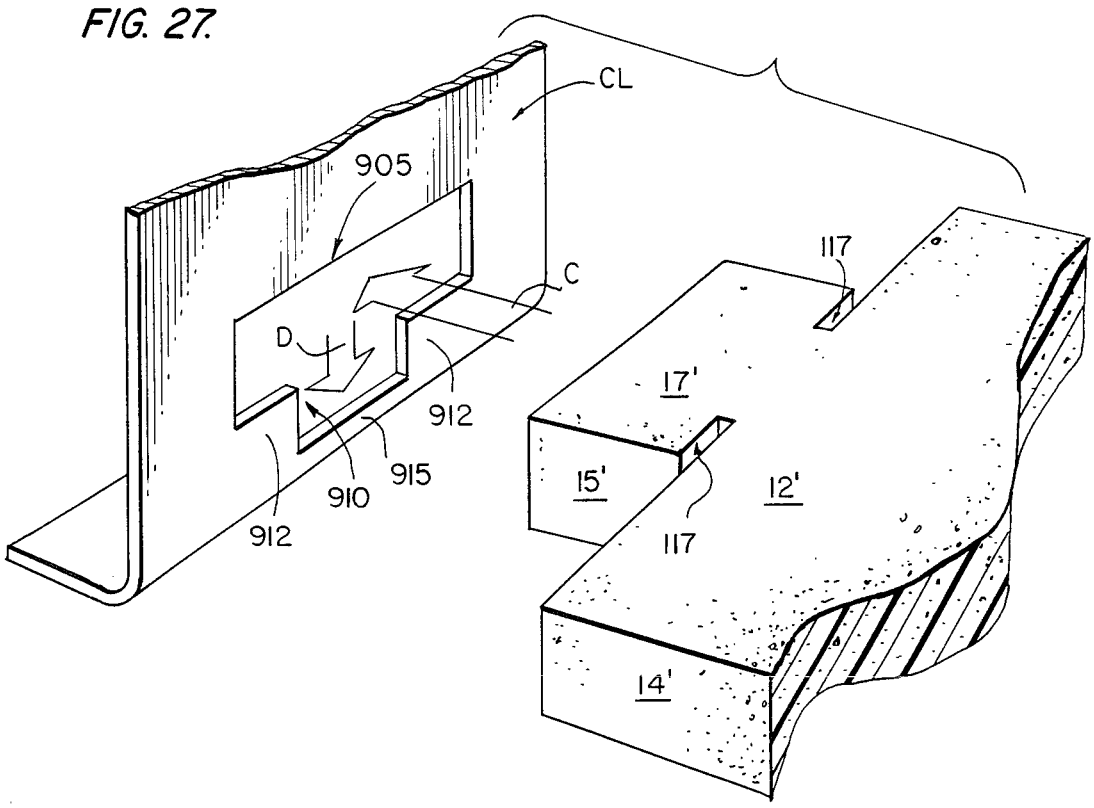
FIG. 27 is a perspective view of an old style clip as modified for use with a short tenon with recess embodiment of FIG. 9.
Figure 28:
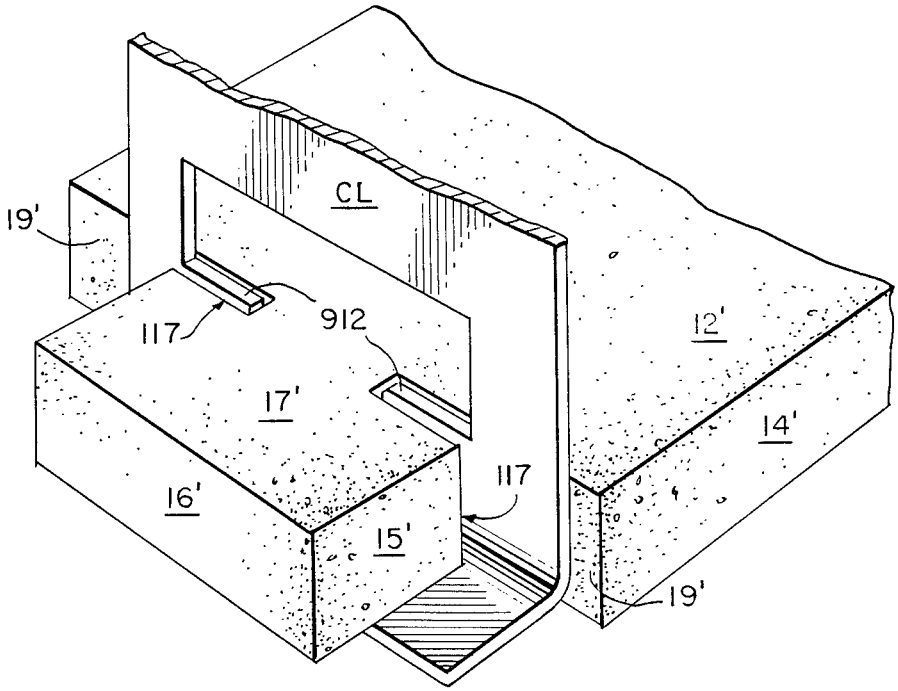
FIG. 28 is a perspective view of the FIG. 27 showing viewed from the other side of the clip.

FIGS. 27 and 28 show a modified retainer clip of basically prior art configuration which has been modified for use with the new and improved spacer block, short tenon embodiment of the present invention. In this modification, the retainer clip CL has a rectangular opening 905 provided therewithin which receives the short tenon end 17' of the spacer block. In addition, a notch or recess 910 extends downwardly from opening 905 so that projecting areas 912 are provided on the retainer clip. These projecting right angular tips 912 will engage with the slots in recesses 117 of the spacer block. Though not shown in these views, a recess or slot 119 may be provided at the bottom of the spacer block which will fit over the lower portion 915 of the recess 910 of the retainer clip.

Figure 29:
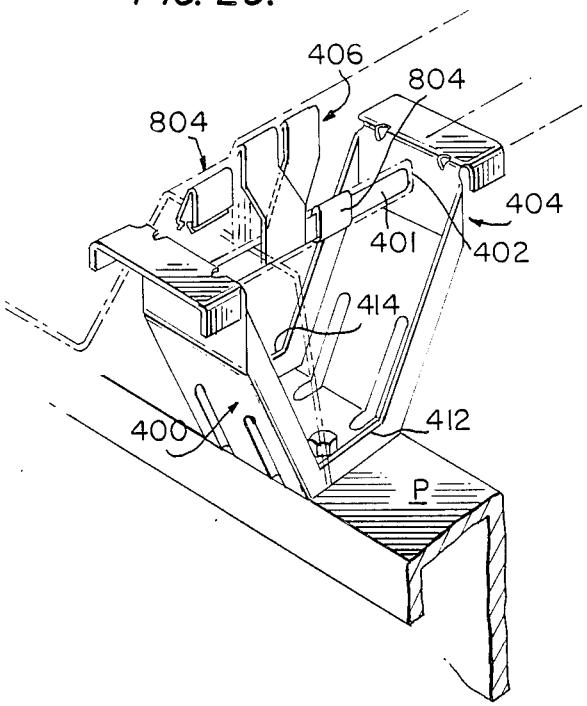
FIG. 29 shows a perspective view of the improved yoke type roof panel fastening and attachment clip as preferably used with the present invention.
Figure 21:
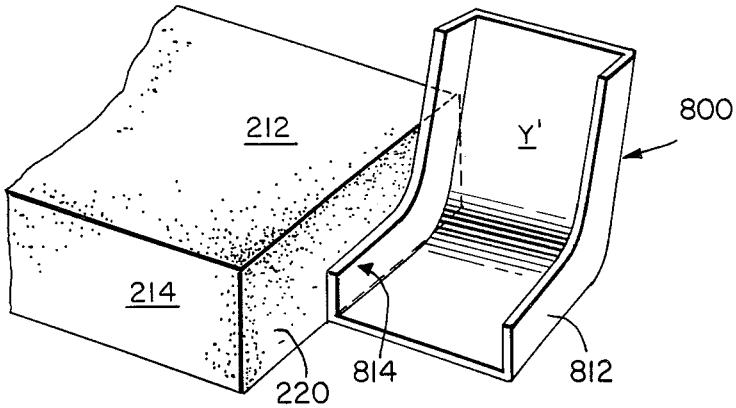
FIG. 21 is a perspective view of the other end of the FIG. 19 embodiment showing the square or blunt surface thereof together with a roof panel attachment clip therewith.
Figure 22:
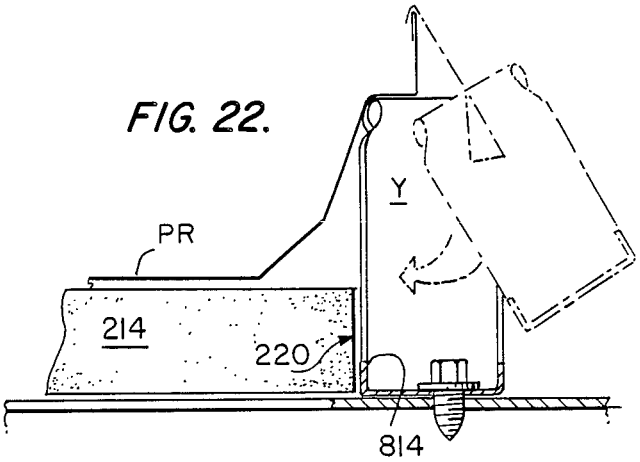
FIG. 22 is a side elevational view of the blunt end of the FIG. 21 showing, together with a yoke clip as being installed.
Figure 24:
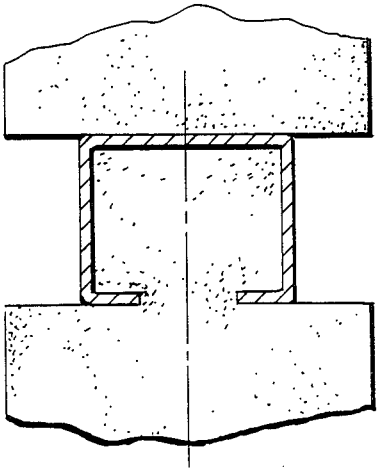
FIG. 24 is a top plan view of the FIG. 23 showing.
Figure 23:
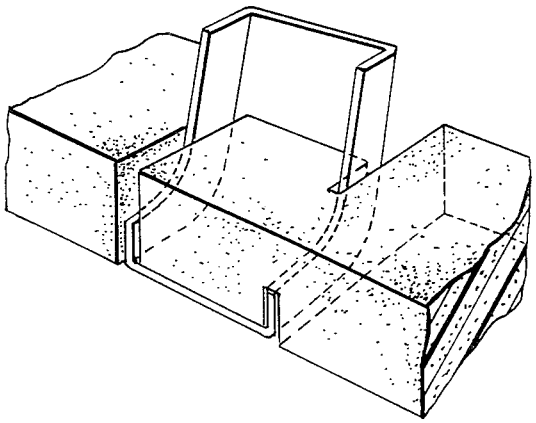
FIG. 23 is a perspective view of a long tenon, square end embodiment with pre-notched recesses of FIG. 20 and with another spacer block installed.

FIG. 29 shows a yoke type fastener and retainer clip as preferably used in the present invention. This clip is like that shown in FIGS. 12, 13 of co-pending application Ser. No. 556,194, filed on Nov. 29, 1983 and assigned to the same assignee as this application. The subject matter of this co-pending application is hereby specifically incorporated herein by reference thereto. The yoke 400 supports a triangular shaped cross-bar 401 which is supported and mounted in triangular apertures 402 of the upper part of the yoke structure 404. Snap-on retainer clips 804 preferably are also used to center and hold roof retaining tab 406 approximately mid-center of cross-piece 401. The upstanding flanges 412 and 414 are the ones already described for use in combination with installation of the respective spacer block embodiments.

It also should be noted in FIG. 26 that the centerline CLO of the respective ends of the oxbow spacer block is shown as CLO, and the centerline of the tenon projection 217' is indicated as CLT. Thus, an offset portion Z exists in the various embodiments of the oxbow type spacer block, whether the projecting tenon is short or long or has recesses provided therewith or not. This distinction is emphasized, since in the rectangular spacer block embodiments, the centerline of the holding and aligning structures, i.e., the projecting tenons, either short or long, recessed or not, are along the same centerline of the spacer block itself.

These together with other objects and advantages which will become subsequently apparent reside in the details of construction and operation as more fully hereinafter described and claimed, reference being had to the accompanying drawings forming a part hereof, wherein like reference numerals refer to like parts throughout.

We claim:

1. A standing seam roof panel support device, comprising:

an elongated spacer block for supporting and spacing a roof panel upon a building roof structural element;

external aligning means on one end of said spacer block for contacting engagement with a roof panel mounting clip;

additional external aligning means on the other end of said spacer block for complementary association with another roof panel mounting clip; and said external aligning means on said one end of said spacer block for engaging a roof panel mounting clip comprising a single tenon projection extending outwardly from said end so that transverse flanges on said mounting clip can transversely engage with said tenon projection on opposite sides thereof to locate and align the spacer block both longitudinally and laterally on the roof structural element.

2. A support device as set forth in claim 1, wherein transverse mounting clip flange receiving recesses are provided in said tenon projection on opposite sides thereof.

3. A support device as set forth in claim 1, wherein said spacer block is made of lightweight insulating material and has a length many times longer than the width thereof.

4. A support device as set forth in claim 3, wherein said spacer block is of rectangular configuration.

5. A support device as set forth in claim 3, wherein said spacer block is of oxbow configuration.

6. A support device as set forth in claim 3, where said additional external aligning means on said other end of said spacer block for contacting engagement with a roof panel mounting clip includes a substantially square end.

7. A support device as set forth in claim 3, wherein said additional external aligning means on the other end of said spacer block includes said end having a tapered configuration.

8. A support device as set forth in claim 7, wherein said tapered configuration includes a compound tapered end on said spacer block.

9. A support device as set forth in claim 3, wherein said additional external aligning means on the other end of said spacer block includes a reduced end of designed configuration for reception within a yoke structure of the roof panel mounting clip.

10. A support device as set forth in claim 9, wherein the shape of said designed configuration is selected from the group consisting of a compound tapered end, an oval end, a conical end, and a combination of the aforedescribed shapes.

11. An improved support structure for a standing seam roof for a building of pre-fabricated construction comprising:

a plurality of building roof elements at the top of a building construction frame;

a plurality of roof panel fastening clips for attachment to said building roof element;

an elongated spacer block having two ends for mounting between two adjacent fastening clips;

external aligning means on one end of said spacer block for mating engagement with a first roof panel mounting clip, additional external aligning means at the other end of said spacer block for complementary engagement with another roof panel mounting clip for the purpose of aligning and retaining said spacer block in correct position over said building roof support element for supporting a roof panel thereupon;

said additional external aligning means at the other end of said spacer block comprising a pointed end formed thereon; and said external aligning means on said one end of said spacer block having a tenon projection extending therefrom, said tenon projection engageable with flanges provided with the roof panel fastening clip, said flanges being perpendicular to the length of said spacer block for traverse engagement with said tenon projection.

12. An improved support structure as set forth in claim 11, wherein said tenon projection has pre-notched traversely extending recesses extending at least partially therearound for receiving said flanges of the associated fastening clip.

13. An improved support structure as set forth in claim 11, wherein said pointed end is of compound tapered configuration.

14. An improved support structure as set forth in claim 11, wherein said pointed end is of conical configuration.

15. An improved support structure as set forth in claim 11, wherein said pointed end is of tapered oval configuration.

16. An improved support structure as set forth in claim 11, wherein said spacer block is of substantially elongated rectangular configuration having parallel sides and ends, and is made of lightweight, insulating material.

17. An improved support structure as set forth in claim 11, wherein said spacer block has an oxbow shape, and is formed of lightweight insulating material.

18. An improved support structure as set forth in claim 11, wherein said plurality of fastening clips are spaced approximately 2 ft. apart on each of the respective building roof support elements during assembly of the building roof.

19. An improved support structure as set forth in claim 18, wherein said 2 ft. spacings occur from the leading edge of the first roof panel fastening clip to the leading edge of the next adjacent roof panel fastening clip.

20. An improved support structure as set forth in claim 18, wherein said roof panel fastening clips are spaced 2 ft. apart center-to-center of said respective fastening clips.

21. An insulating spacer block for use in a standing seam roof construction including a plurality of elongate roof support purlins with spaced apart roof mounting clips having opposed inturned flanged directed laterally to the elongate dimension of the purlins and secured on top of the purlins, said spacer block being adapted to be placed in overlying, aligned relationship above the purline and between the mounting clips, and comprising:

an elongate body of lightweight insulating material and having opposite ends and a longitudinal axis; and said body having external aligning means on the opposite end thereof for cooperation with roof panel mounting clips to maintain the spacer block in aligned position between the clips, said aligning means on at least one end of the spacer block comprising a single tenon projecting form said end and having a longitudinal axis parallel to the longitudinal axis of the body, said tenon being adapted to be placed between the opposed laterally directed flanges of a roof mounting clip so that the flanges on the clip laterally engage against opposite sides of the tenon to locate and align the spacer block with respect to the mounting clip and thus the roof purlin to which the clip is secured.

22. In a standing seam roof construction including a plurality of elongate parallel roof support purlins, standing seam roof panels supported by the purlins, and roof panel fastening clips secured on the purlins in spaced relationship therealong for attaching the roof panels to the purlins, said clips having spaced apart flanged turned inwardly toward one another in a direction transverse to the longitudinal axis of the purlins, and elongate spacer bars of insulating material extending lengthwise between the fastening clips on top of the purlins for insulating the area between the purlins, roof panels and clips, the improvement comprising:

external aligning means on opposite ends of the spacer bars for locating and aligning said spacer bars relative to the fastening clips in both the lateral and longitudinal directions, said external aligning means comprising a single tenon projecting from at least one end of the spacer bar and adapted to extend between and in engagement with the spaced, transverse flanges of the fastening clip at said one end of the spacer bar to laterally and longitudinally locate and align said spacer bar between said fastening clips.

* * * * *